US006211831B1

(12) United States Patent
Nagy et al.

(10) Patent No.: US 6,211,831 B1
(45) Date of Patent: Apr. 3, 2001

(54) CAPACITIVE GROUNDING SYSTEM FOR VHF AND UHF ANTENNAS

(75) Inventors: Louis Leonard Nagy; Douglas Courtney Martin, both of Warren; Michael Jerome Lewis, Southfield, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/339,652

(22) Filed: Jun. 24, 1999

(51) Int. Cl.[7] ..... H01Q 1/32
(52) U.S. Cl. ..... 343/713; 343/700 MS
(58) Field of Search ..... 343/713, 700 MS, 343/704, 711, 712

(56) References Cited

U.S. PATENT DOCUMENTS 5,083,135 * 1/1992 Nagy et al. ..... 343/713
5,181,044 * 1/1993 Matsumoto et al. ..... 343/752
5,528,314 6/1996 Nagy et al. ..... 348/713
5,596,335 * 1/1997 Dishart et al. ..... 343/713
5,818,394 * 10/1998 Aminzadeh et al. ..... 343/713
5,821,904 * 10/1998 Kakizawa et al. ..... 343/704
5,929,812 * 7/1999 Aminzadech ..... 343/700 MS
5,959,581 * 9/1999 Fusinski ..... 343/700 MS
6,031,500 * 2/2000 Nagy et al. ..... 343/713

* cited by examiner

*Primary Examiner*—Don Wong
*Assistant Examiner*—Trinh Vo Dinh
(74) *Attorney, Agent, or Firm*—Jimmy L. Funke

(57) ABSTRACT

A capacitive grounding system for VHF and UHF antennas (50). An outer shield (70) of a coaxial feed cable (52) is capacitively coupled to a vehicle body panel (60) proximate an edge (74) of the body panel (60) adjacent a vehicle window opening. The feed cable (52) is attached to the body panel (60) by tape (66) or glue. The resulting capacitance between the outer shield (70) and the vehicle body panel (60) provides a very low impedance path for RF signals.

18 Claims, 2 Drawing Sheets

CAPACITIVE GROUNDING SYSTEM FOR VHF AND UHF ANTENNAS

TECHNICAL FIELD

This invention relates generally to a vehicle antenna system and, more particularly, to a vehicle antenna system including an improved capacitive grounding system for a VHF and UHF vehicle antenna system.

BACKGROUND OF THE INVENTION

Most modern vehicles include a vehicle radio that requires an antenna system to receive amplitude modulation (AM) and frequency modulation (FM) broadcasts from various radio stations. Many vehicle antenna systems include a dipole antenna that extends from a vehicle fender, vehicle roof, or some applicable location on the vehicle to receive these broadcasts. Improvements in vehicle antenna systems have included the development of backlite antenna systems, where antenna elements are formed on a rear window of the vehicle. The antenna elements in the backlite antenna systems are typically made of a conductive frit deposited on an inside surface of the window. Additionally, vehicle windshield antennas, such as the Solar-Ray antenna disclosed in U.S. Pat. No. 5,528,314, have also been developed. The Solar-Ray antenna includes a transparent conductive film laminated between the inner and outer glass sheets of the windshield. The windshield and backlite antenna systems provide a number of advantages over mast antenna systems, including no wind noise, reduced drag on the vehicle, elimination of corrosion of the antenna elements, no performance change with time, limited risk of vandalism, and reduced cost and installation.

Advancements in vehicle communication technologies has led to the need for various high frequency antennas to provide reception for different communication systems, such as radio frequency accessory (RFA) and key-less entry systems, cellular telephone, global positioning systems (GPS), personal communication systems (PCS), toll systems, garage door openers, etc. Because these antenna systems operate at higher frequencies than the AM and FM frequency bands, the size of the antenna is reduced from AM and FM antenna systems. These high frequency antennas must be positioned on a vehicle at a location where the antenna radiation is not adversely effected by the conductive vehicle body. It has been suggested to incorporate high frequency antennas in the vehicle windshield or backlite glass in combination with the existing AM/FM antennas. In one design, the high frequency antennas are mounted on an inside surface of the inside glass sheet of the windshield along a tinted top edge of the windshield so that they do not obstruct the view of the vehicle operator.

Each of the various vehicle window antennas typically include an antenna feed that is usually a coaxial cable connected to the antenna at a location suitable for optimum performance. The cable can be either directly connected to the antenna element or capacitively coupled to the antenna element through the vehicle glass. The center conductor of the cable is electrically connected to the antenna element and the outer conductor or outer shield of the cable is electrically connected to the vehicle ground, usually a vehicle body panel. An antenna design providing optimum performance would require that the outer shield of the coaxial feed cable be terminated and DC grounded to the vehicle body panel as close as possible to the edge of the window opening. This location provides a low impedance path for both DC and RF signals. However, antenna performance measurements indicate that the actual ground point for the feed cable can be located a distance of up to one-twentieth of the desirable reception wavelength S without significantly affecting the reception characteristics of the antenna.

In one known design, the DC ground for the Solar-Ray antenna is provided by soldering a metal bracket to the outer shield of the feed cable. The bracket is attached to the vehicle body by a ground screw about five inches from the window opening, or about S/25 of the middle of the FM frequency band. It has been determined that this type of feed arrangement would be unacceptable for proposed UHF and VHF antennas because of certain manufacturing concerns.

It is an object of the present invention to provide an alternate grounding system for these UHF and VHF vehicle antennas.

SUMMARY OF THE INVENTION

In accordance with the teachings of the present invention, a capacitive grounding system is disclosed for a VHF and UHF vehicle antenna. The outer shield of a coaxial feed cable is capacitively coupled to a vehicle body panel at an edge of the vehicle body panel proximate a vehicle window opening. The feed cable is attached to the vehicle body panel by taping, gluing, etc. at this location. The resulting capacitance between the outer shield and the vehicle body panel results in a very low impedance path for RF signals.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to capacitively coupling an outer shield of a coaxial feed cable for a VHF and UHF vehicle antenna is merely exemplary in nature, and is in no way intended to limit the invention or its applications or uses. Particularly, the discussion below will refer to a feed cable for an RFA antenna in a vehicle. However, the invention can be used for other vehicle antennas as well as non-vehicle antennas.

Figure 1:
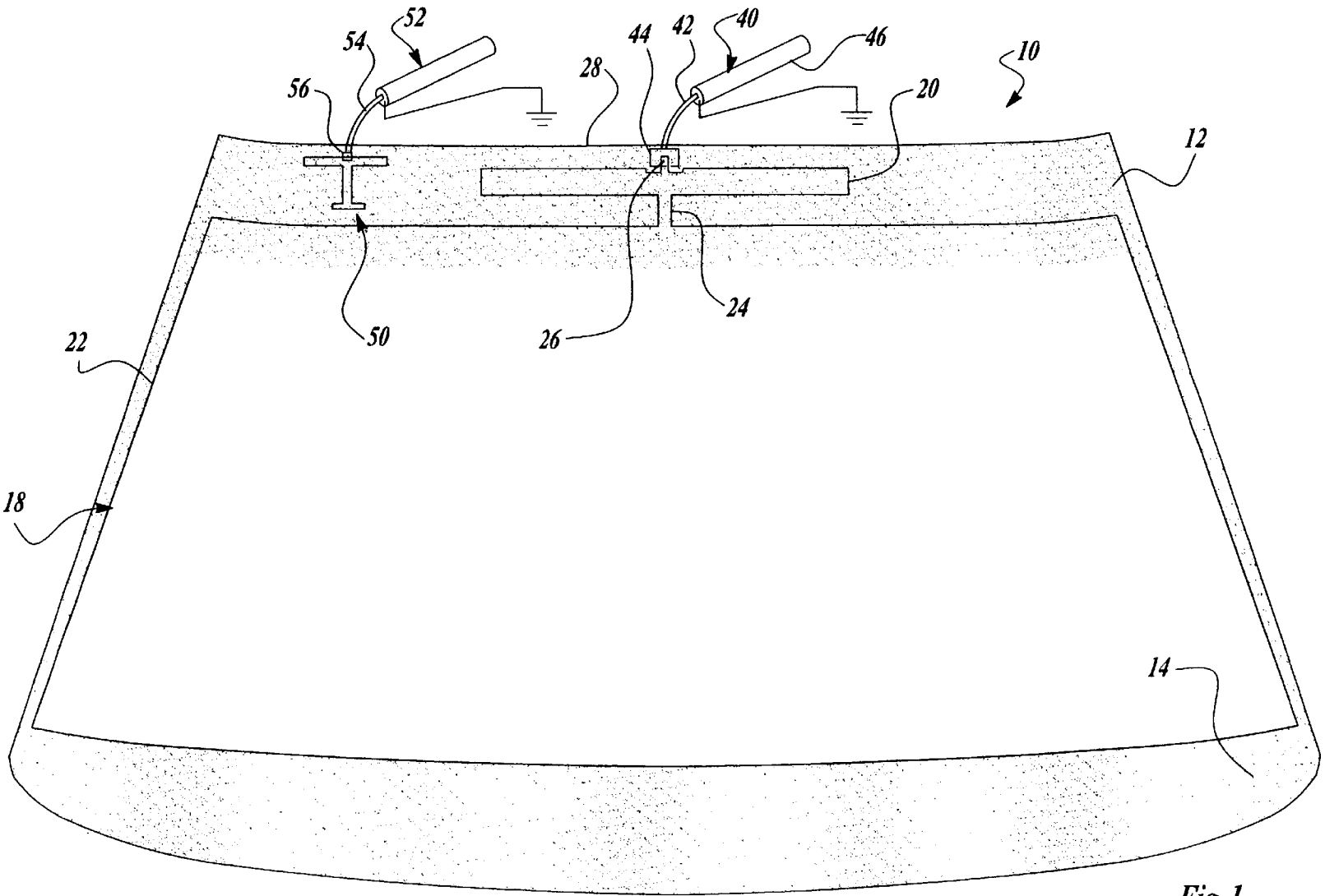
FIG. 1 is a plan view of a vehicle windshield including an RFA antenna and a Solar-Ray antenna, and associated coaxial feed cables, according to an embodiment of the present invention.

FIG. 1 is a front plan view of a vehicle windshield 10 removed from the vehicle (not shown). The windshield 10 includes an upper tinted region 12 and a shaded border 14. The windshield 10 further includes a Solar-Ray antenna 18 for providing AM and FM reception of the type disclosed in the '314 patent referred to above. The Solar-Ray antenna 18 includes a conductive film configured as shown to include a tuning element 20 and an impedance element 22, where the tuning element 20 runs along an upper edge 28 of the windshield 10. The antenna 18 further includes a vertical connecting portion 24 connecting the impedance element 22 to the tuning element 20. A connecting tab 26 extends vertically up from tuning element 20 almost to the upper edge 28 of the windshield 10. The conductive film is formed on an inside surface of an outer glass layer 30 of the windshield 10 so that it is positioned between the outer glass layer 30 and an inner glass layer 32 (see FIG. 3) of the windshield 10.

A coaxial feed cable 40 provides the feed connection to the antenna 18, and is connected to the tuning element 20 at a desirable location to provide optimum antenna performance. A center conductor 42 of the cable 40 is connected to a conductive patch 44 formed on an inside surface of the outer glass layer 30 of the windshield 10. The patch 44 is positioned at a location so that it is electrically coupled to the connecting tab 26 on the outer glass layer 30. An outer shield 46 of the cable 40 is grounded to a vehicle body panel at a suitable location close to the edge of the vehicle body panel, as discussed above.

The windshield 10 also includes a "T-shaped" patch antenna 50, also formed between the inner layer 32 and the outer glass layer 30 of the windshield 10 in the tinted region 12. The patch antenna 50 is a high frequency antenna for receiving VHF and UHF signals, and has a particular application for use as an RFA antenna. The antenna 50 has other high frequency applications, including being used as a GPS antenna, toll antenna, garage door opener antenna, PCS antenna, etc. A coaxial feed cable 52 provides the feed to the antenna 50. The cable 52 includes a center conductor 54 that is electrically connected to a conductive patch 56 formed on an inside surface of the inner glass layer 32 of the windshield 10. The conductive patch 56 is capacitively coupled through the inner glass layer 32 to the antenna 50 in this embodiment. In an alternate embodiment, the antenna 50 can be formed on an inside surface of the inner glass layer 32. In this embodiment, the center conductor 54 would be directly connected to the antenna 50, and, for example, the patch 56 shown in FIG. 3 would be the antenna 50.

Figure 2:
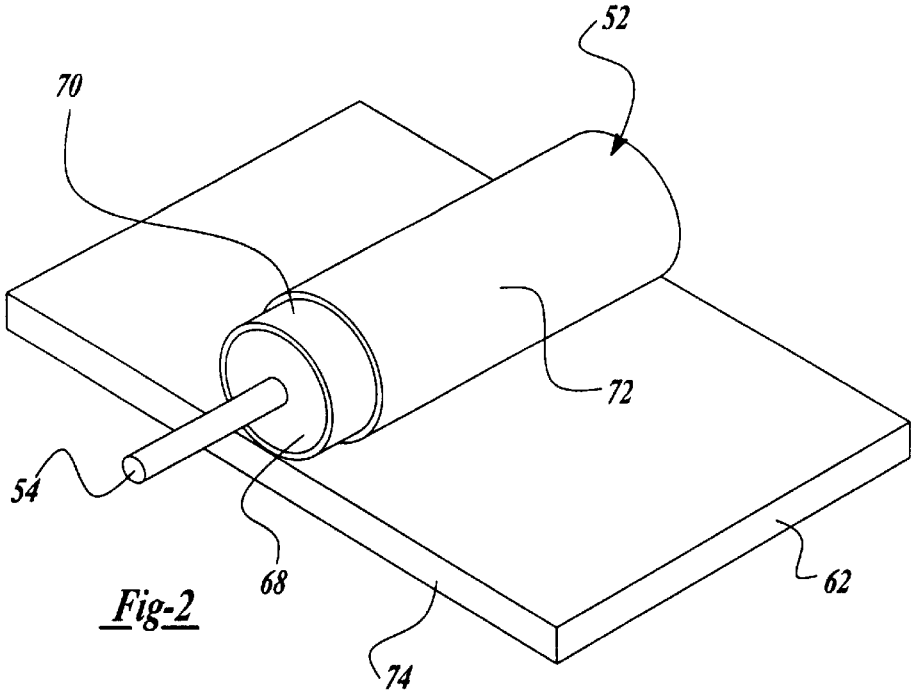
FIG. 2 is plan view of an end of the RFA feed cable shown in FIG. 1 mounted at an edge of a vehicle body panel, according to an embodiment of the present invention.
Figure 3:
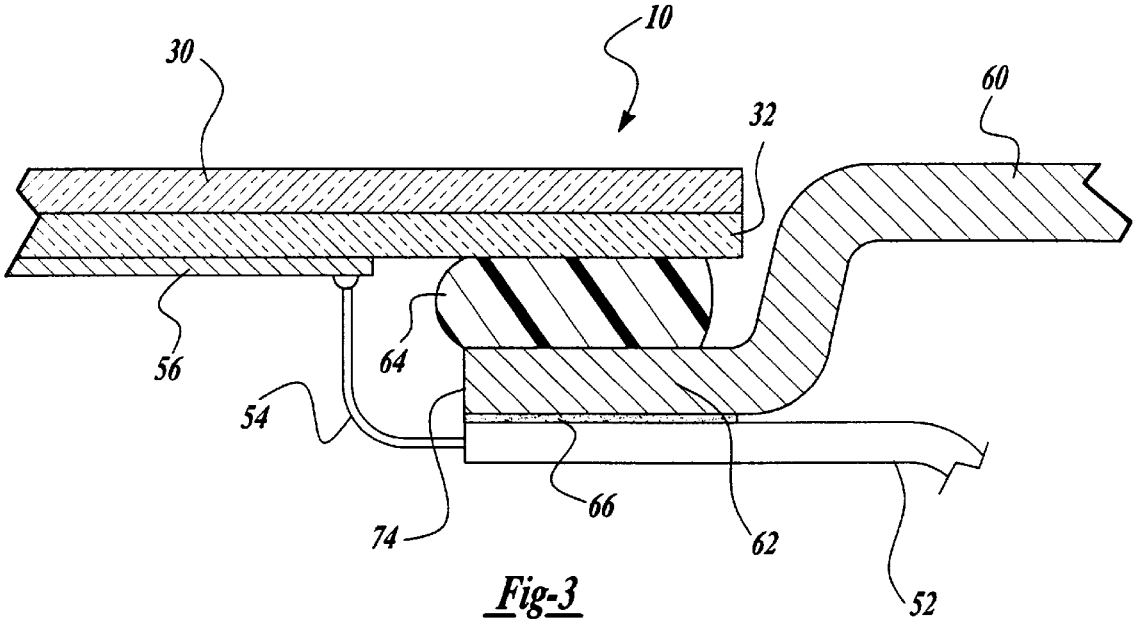
FIG. 3 is a cross-sectional view of the RFA feed cable mounted to the vehicle body.

FIG. 2 is a perspective view of a portion of the cable 52 mounted to a vehicle body panel 60. FIG. 3 is a cross-sectional view of a portion of the body panel 60 and the windshield 10 showing the connection of the cable 52 to the antenna 50. The windshield 10 rests on a flange 62 of the body panel 60, and is sealed thereto by a sealing strip 64, such as a urethane sealing strip, as is known in the art. The cable 52 can be mounted to the body panel 60 by any suitable fastening device, such as glue, tape, etc. In this embodiment, the cable 52 is mounted to the flange 62 by an adhesive strip 66 over a distance of about 100 mm along the length of the cable 52. In addition to the center conductor 54, the cable 52 includes a coaxial arrangement of an internal dielectric layer 68, an outer shield 70 and an outer dielectric covering 72, as shown. As is apparent, the outer shield 70 is positioned flush with an edge 74 of the body panel 60 proximate the opening for the windshield 10.

In this embodiment, the outer shield 70 is positioned flush with the edge 74, so that it is as close to the window opening as possible. In alternate designs for different antennas, the cable 52 can be mounted to the body panel 60 slightly away from the edge 74, with the requirement that it be within one-twentieth of the wavelength of the frequency band of interest. The resulting capacitance between the outer shield 70 and the body panel 60 provides a very low impedance path for RF signals. This low impedance path for FM and RFA signals is much less than their respective cable impedances, i.e., 125 Ohms for the FM cable and 50 Ohms for the RFA cable.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna system for a vehicle, said antenna system comprising: an antenna element;

a coaxial antenna feed cable including a center conductor, a dielectric layer surrounding the center conductor, and an outer shield surrounding the dielectric layer, said center conductor being electrically coupled to the antenna element; and a vehicle body panel, said body panel including an edge proximate the antenna element, said feed cable being mounted to the body panel proximate the edge so that the outer shield is capacitively coupled to the body panel to provide an antenna ground, wherein one end of the outer shield is substantially aligned with the edge.

2. The antenna system according to claim 1 wherein the antenna element is formed on a vehicle window and said body panel is adjacent to an opening in which the window is mounted, said edge defining the opening.

3. The antenna system according to claim 2 wherein the antenna element is formed on an inside surface of the window, and wherein the center conductor is directly connected to the antenna element.

4. The antenna system according to claim 2 wherein the window is a vehicle windshield, said antenna element being formed between outer and inner glass layers of the windshield.

5. The antenna system according to claim 4 further comprising a conductive patch formed on an inside surface of the inner glass layer, said center conductor being electrically connected to the patch and said patch being capacitively coupled to the antenna element through the inner glass layer.

6. The antenna system according to claim 1 wherein the antenna element is part of an antenna selected from the group consisting of cellular antennas, Solar-Ray antennas, toll antennas, garage door antennas, radar antennas, RFA antennas, keyless entry antennas, PCS antennas and GPS antennas.

7. The antenna system according to claim 1 wherein the cable is mounted to the body panel by a fastening device selected from the group consisting of glue and tape.

8. The antenna system according to claim 1 wherein the antenna element is positioned in an upper tinted region of a vehicle windshield.

9. The antenna system according to claim 1 wherein the outer shield is mounted to the vehicle body panel within one-twentieth of the desirable reception wavelength from the edge.

10. An antenna system for a vehicle, said antenna system comprising:

a vehicle windshield;

a Solar-Ray antenna formed in the windshield;

a high frequency antenna element positioned in the windshield adjacent an upper edge of the windshield;

a coaxial antenna feed cable including a center conductor, a dielectric layer surrounding the center conductor, and an outer shield surrounding the dielectric layer, said center conductor being capacitively coupled to the antenna element; and a vehicle body panel, said body panel including an edge proximate the antenna element, said feed cable being mounted to the body panel proximate the edge so that the outer shield is capacitively coupled to the body panel to provide an antenna ground, wherein one end of the outer shield is substantially aligned with the edge.

11. The antenna system according to claim 10 further comprising a conductive patch formed on an inside surface of an inner glass layer, said center conductor being electrically connected to the patch and said patch being capacitively coupled to the antenna element through the inner glass layer.

12. The antenna system according to claim 10 wherein the antenna element is formed on an inside surface of the windshield, and the center conductor is directly connected to the antenna element.

13. The antenna system according to claim 10 wherein the antenna element is part of an antenna selected from the group consisting of cellular antennas, Solar-Ray antennas, toll antennas, garage door antennas, radar antennas, RFA antennas, PCS antennas and GPS antennas.

14. The antenna system according to claim 10 wherein the feed cable is mounted to the body panel by a fastening device selected from the group consisting of glue and tape.

15. The antenna system according to claim 10 wherein the outer shield is mounted to the vehicle body panel within one-twentieth of the desirable reception wavelength from the edge.

16. A method of connecting a coaxial antenna feed cable to a vehicle antenna element, said method comparing the steps of:

mounting the cable to a vehicle body panel, wherein said body includes an edge proximate the antenna element, so that an outer shield of the cable is capacitively coupled to the body panel to provide an antenna ground, wherein one end of the outer shield is substantially aligned with the edge; and electrically coupling a center conductor of the feed cable to the antenna element.

17. The method according to claim 16 wherein the step of mounting includes mounting the cable to a vehicle body panel adjacent a vehicle window, said antenna element being on the vehicle window.

18. The method according to claim 16 wherein the step of mounting includes using glue to mount the cable.

* * * * *